US006374657B1

(12) United States Patent
Kirk et al.

(10) Patent No.: US 6,374,657 B1
(45) Date of Patent: Apr. 23, 2002

(54) METHOD OF MAKING BUMP-UP CAN BOTTOM

(75) Inventors: William A. Kirk, North Canton; Benjamin Derr, Massillon, both of OH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/699,742

(22) Filed: Oct. 30, 2000

(51) Int. Cl.[7] ..... B21D 22/26
(52) U.S. Cl. ..... 72/348; 72/379.4
(58) Field of Search ..... 72/348, 349, 379.2

(56) References Cited

U.S. PATENT DOCUMENTS

| | | | | |
|---|---|---|---|---|
| 5,160,031 A | * | 11/1992 | Palisin, Jr. et al. | 72/349 |
| 5,699,932 A | | 12/1997 | Claydon et al. | |
| 5,899,355 A | | 5/1999 | Claydon et al. | |
| 5,938,389 A | | 8/1999 | Shore et al. | |

FOREIGN PATENT DOCUMENTS

| | | |
|---|---|---|
| DE | P2308420.0 | 2/1973 |
| EP | 0425124 B1 | 10/1990 |
| GB | 703836 | 2/1954 |
| WO | WO 83/01916 | 6/1983 |

* cited by examiner

*Primary Examiner*—Lowell A. Larson
(74) *Attorney, Agent, or Firm*—Knoble & Yoshida, LLC

(57) ABSTRACT

A method of making a can body of the type that has at least one axially extending rib formed therein includes a first forming step of creating a preform having a sidewall that has at least one axially extending rib formed therein and a bottom that is coextensive with the sidewall and intersects the sidewall at a rim. This first forming step is performed so that at least a portion of the bottom is recessed by a predetermined depth with respect to the rim. The method further includes a second step of performing a second drawing operation on the preform to form a can body having a bump-up bottom. It is important that the predetermined depth be sufficient to prevent the axially extending rib to be drawn into said bump-up bottom.

13 Claims, 1 Drawing Sheet

METHOD OF MAKING BUMP-UP CAN BOTTOM

BACKGROUND OF THE INVENTION

1. Field of the Invention

This invention relates to can bodies of the type that include a sidewall having flutes or grooves defined therein, and to a method and apparatus for making such can bodies using the draw-redraw process that is typically used for making 2-piece can bodies.

2. Description of the Related Technology

Features such as ribs and flutes in the sidewalls of can bodies have long been known, and have been used for several reasons. One reason is to give an interesting appearance to the can body which may promote a brand image, as is discussed in U.S. Pat. No. 5,938,389 to Shore et al. Longitudinal ribs and panels have also been used to impart additional rigidity to the sidewall against loads applied to the top of the can body, such as arise during double seaming of a can end to close the body, or during stacking of filled cans. This is more fully discussed in U.S. Pat. No. 5,699,932.

The process of making can bodies using the draw-redraw forming technique has been in commercial use for decades. This process is accomplished by performing a first draw to create a cup having a large diameter and then performing a second draw using the preformed cup so that a punch is relatively moved into engagement with a redrawing die. An annular cup-holding member is arranged within the preliminarily drawn cup, and a bottom face of the preliminarily drawn cup is held by the holding member and the flat face portion of the redrawing die. At the redrawing step, the holding member is moved synchronously with the redrawing die. In this structure, at the relative movement of the punch and the die, the preliminarily drawn cup is draw-formed into a deep-draw-formed cup having a small diameter by a curvature comer portion of the redrawing die and simultaneously, the side wall of the preliminarily drawn cup is bent and elongated and the thickness of the side wall is reduced. At the deep-draw forming, the holding member and the flat face portion of the redrawing die act as the blank holding face to a portion of the cup on which influences of the plastic flow are imposed.

Companies that package food products and other articles in two piece cans often prefer a bottom configuration that has what is known in the industry as a "bump-up." A bump-up bottom is characterized as having a downwardly facing annular projection in the outer circumferential area at which it is coextensive with the container sidewall. Bump-up bottoms may also have similar, concentric annular projections that are positioned in the interior of the container bottom, radially inward from the major projection.

The inventors have for some time been attempting to create a viable draw-redraw manufacturing process for two piece cans having a bump-up bottom and axial ribs in the sidewall, but have experienced the problem that the axial ribs tend to be drawn into the major projection of the bump up bottom. For aesthetic and other reasons, this is unacceptable. A need exists for an improved manufacturing process for two piece cans of the type having a bump-up bottom and axial sidewall ribs that ensures ample material in the bottom area of the can body preform so as to prevent the sidewall ribs from being drawn into the bump-up area.

SUMMARY OF THE INVENTION

It is, accordingly, an object of the invention to provide an improved manufacturing process for two piece cans of the type having a bump-up bottom and axial sidewall ribs that ensures ample material in the bottom area of the can body preform so as to prevent the sidewall ribs from being drawn into the bump-up area.

In order to achieve the above and other objects of the invention, a method of making a can body of the type that has at least one axially extending rib formed therein includes, according to a first aspect of the invention, steps of performing a first drawing operation to create a cup having a sidewall that has at least one axially extending rib formed therein and a bottom that is coextensive with the sidewall and intersects the sidewall at a rim, this step being performed so that at least a portion of the bottom is recessed by a predetermined depth with respect to the rim; and performing a second drawing operation on the cup to form a can body having a bump-up bottom, and wherein the predetermined depth is sufficient so as to prevent the axially extending rib to be drawn into the bump-up bottom.

According to a second aspect of the invention, a method of making a can body of the type that has at least one axially extending rib formed therein includes steps of providing a cup having a sidewall and a bottom that is coextensive with the sidewall and intersects the sidewall at a rim, this step being performed so that at least a portion of the bottom is recessed by a predetermined depth with respect to the rim; and performing a forming operation on the cup to form a can body having at least one axial rib defined in its sidewall and having a bump-up bottom, and wherein the predetermined depth is sufficient so as to prevent the axially extending rib to be drawn into the bump-up bottom during the forming operation.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
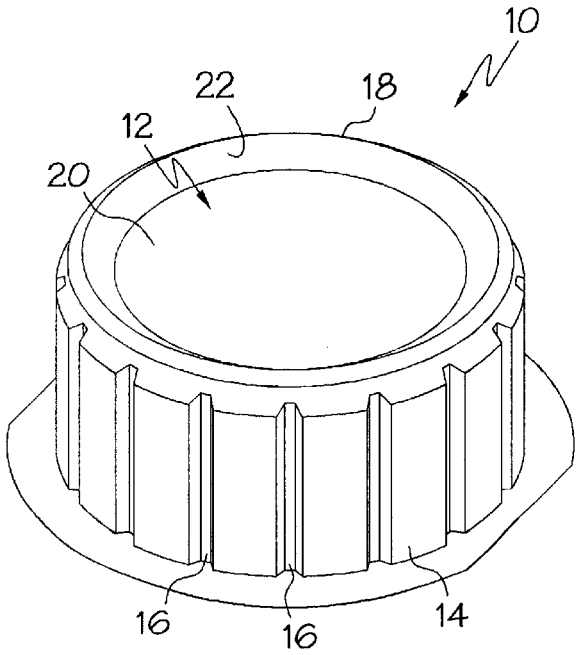
FIG. 1 is a first perspective view depicting a first step in a method according to a preferred embodiment of the invention.

Referring now to the drawings, wherein like reference numerals designate corresponding structure throughout the views, and referring in particular to FIG. 1, a method that is performed according to a preferred embodiment of the invention includes a step of providing a preform 10 that has a bottom 12 and a sidewall 14. As may be seen in FIG. 1, preform 10 is configured so that sidewall 14 has a plurality of axially extending ribs 16 defined therein. For purposes of this document, the term "ribs" should be construed as broadly encompassing all forms of axially extending structure on a container body, cup or preform that may deviate from the standard cylindrical shape of the sidewall.

Figure 3:
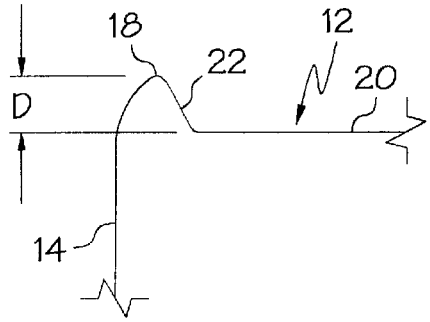
FIG. 3 is a fragmentary diagrammatical view depicting a portion of an article that is illustrated in FIG. 1.

As is shown in FIG. 1, preform 10 is constructed so that side wall 14 is coextensive with bottom 12 and intersects bottom 12 at a circular rim 18 that represents the bottommost dimensional extent of the preform 10. In the preferred embodiment, bottom 12 includes a flat portion 20 that is substantially circular in shape when viewed from beneath the preform 10, as shown in FIG. 1. Flat portion 20 is, as the name implies, substantially flat or residing substantially within a plane. As may perhaps best be seen in FIG. 3, bottom 12 further includes a sloped portion 22 that is coextensive with and joins the flat portion 20 of bottom 12 to the rim 18.

Figure 2:
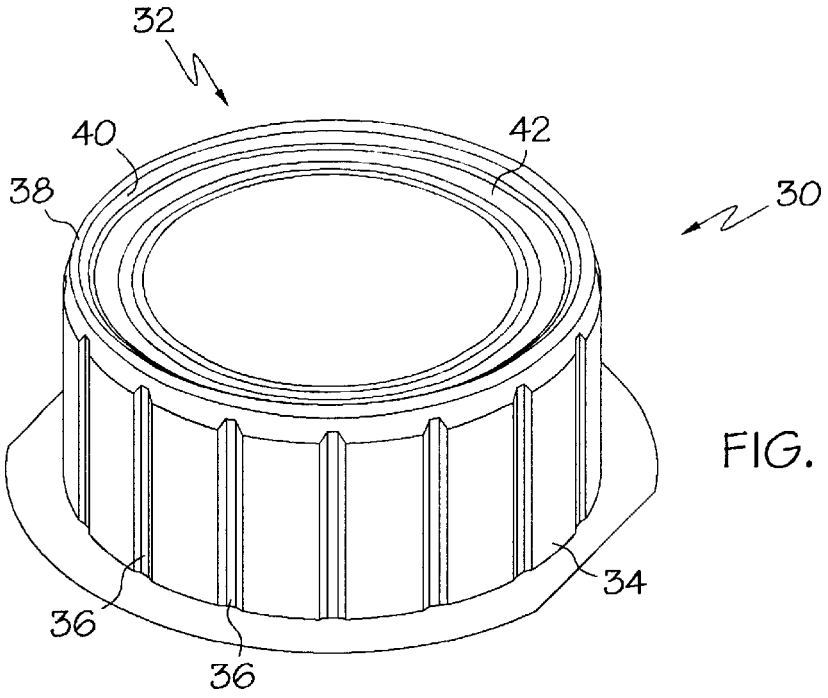
FIG. 2 is a second perspective view depicting a second step in the method that is performed according to the preferred embodiment of the invention.

According to one particularly advantageous feature of the invention, the flat portion 20 of bottom 12 is recessed with respect to the rim 18 by a predetermined distance D that is sufficient to ensure that enough material is present in this general area of the preform 10 so that when the preform 10 is processed in a later forming step into a completed can body of the type having a bump up bottom configuration, as shown in FIG. 2, the axial ribs 16 will not be drawn into the rim area 38 of the container body.

FIG. 2 depicts the completed container body 30 for a two piece can, which includes a bump-up bottom 32 a sidewall 34 having a plurality of axially extending ribs 36 formed therein and the aforesaid rim area 38. The bump-up bottom 32 includes, as is typical, a major projection 40 in the rim area 38 and a number of interior additional annular projections 42.

In the preferred embodiment of the invention, the predetermined depth D is within a range of about 0.03 inches to about 0.30 inches. More preferably, depth D is within a range of about 0.06 inches to about 0.25 inches.

In the preferred embodiment of the invention, the preform 10 depicted in FIG. 1 is formed from a standard cup in a first redraw operation, and the completed container body 30 shown in FIG. 2 is formed from the preform 10 in a second redraw operation. Alternatively, however, the initial cup itself may also be formed so as to have a recessed bottom, so that the formation of the recessed bottom is not necessary in the first redraw operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making a can body of the type that has at least one axially extending rib formed therein, comprising steps of:

(a) performing a first drawing operation to create a cup having a sidewall that has at least one axially extending rib formed therein and a bottom that is coextensive with the sidewall and intersects the sidewall at a rim, step (a) being performed so that at least a portion of said bottom is recessed by a predetermined depth with respect to said rim; and (b) performing a second drawing operation on said cup to form a can body having a bump-up bottom, and wherein said predetermined depth is sufficient so as to prevent said axially extending rib to be drawn into said bump-up bottom.

2. A method according to claim 1, wherein step (a) is performed so that said rim is substantially circular.

3. A method according to claim 1, wherein step (a) is performed to create a cup having a sidewall that has a plurality of axially extending ribs formed therein.

4. A method according to claim 1, wherein step (a) is performed so that said portion of said bottom is substantially flat.

5. A method according to claim 1, wherein step (a) is performed so that said portion of said bottom that is recessed is substantially circular.

6. A method according to claim 1, wherein step (a) is performed so that said predetermined depth is within a range of about 0.03 inches to about 0.30 inches.

7. A method according to claim 6, wherein step (a) is performed so that said predetermined depth is within a range of about 0.06 inches to about 0.25 inches.

8. A method of making a can body of the type that has at least one axially extending rib formed therein, comprising steps of:

(a) providing a cup having a sidewall and a bottom that is coextensive with the sidewall and intersects the sidewall at a rim, step (a) being performed so that at least a portion of said bottom is recessed by a predetermined depth with respect to said rim; and (b) performing a forming operation on said cup to form a can body having at least one axial rib defined in its sidewall and having a bump-up bottom, and wherein said predetermined depth is sufficient so as to prevent said axially extending rib to be drawn into said bump-up bottom during the forming operation.

9. A method according to claim 8, wherein step (a) is performed so that said rim is substantially circular.

10. A method according to claim 8, wherein step (a) is performed so that said portion of said bottom is substantially flat.

11. A method according to claim 8, wherein step (a) is performed so that said portion of said bottom that is recessed is substantially circular.

12. A method according to claim 8, wherein step (a) is performed so that said predetermined depth is within a range of about 0.03 inches to about 0.30 inches.

13. A method according to claim 12, wherein step (a) is performed so that said predetermined depth is within a range of about 0.06 inches to about 0.25 inches.

* * * * *